United States Patent [19]

Sample

[11] 3,943,524

[45] Mar. 9, 1976

[54] TV ANTENNA SUPPORT

[75] Inventor: Louis J. Sample, Flushing, N.Y.

[73] Assignee: The Raymond Lee Organization, Inc., New York, N.Y. ; a part interest

[22] Filed: Oct. 7, 1974

[21] Appl. No.: 512,702

[52] U.S. Cl. ..... 343/888; 248/43; 343/892

[51] Int. Cl.[2] ..... H01Q 1/12

[58] Field of Search..... 248/40, 43, 226 A; 343/878, 880, 888, 892

[56] References Cited

UNITED STATES PATENTS

| | | | |
|---|---|---|---|
| 2,717,751 | 9/1955 | Kusiv | 248/43 |
| 2,933,165 | 4/1960 | Rose | 248/43 X |
| 3,077,613 | 2/1963 | Mayer | 248/226 A X |

*Primary Examiner*—Paul L. Gensler
*Attorney, Agent, or Firm*—Daniel Jay Tick

[57] ABSTRACT

A pair of U-shaped members are affixed to each other in spaced parallel inverted position. Each of the members has a pair of spaced parallel arms joined by a head perpendicular to the arms. An antenna affixing device links the members for supporting a TV antenna in upright position. A fastening device on the members affixes the members in inverse position on a parapet.

1 Claim, 3 Drawing Figures

TV ANTENNA SUPPORT

DESCRIPTION OF THE INVENTION

The present invention relates to a TV antenna support.

Objects of the invention are to provide a TV antenna support of simple structure, which is inexpensive in manufacture, installable on a parapet by anyone, with or without skill, with facility and convenience, and functions efficiently, effectively and reliably to support a TV antenna in substantially upright position.

In order that the invention may be readily carried into effect, it will now be described with reference to the accompanying drawing, wherein.

In the FIGS., the same components are identified by the same reference numerals.

The TV antenna support of the invention mounts a TV antenna 1 on a parapet 2.

Figure 1:
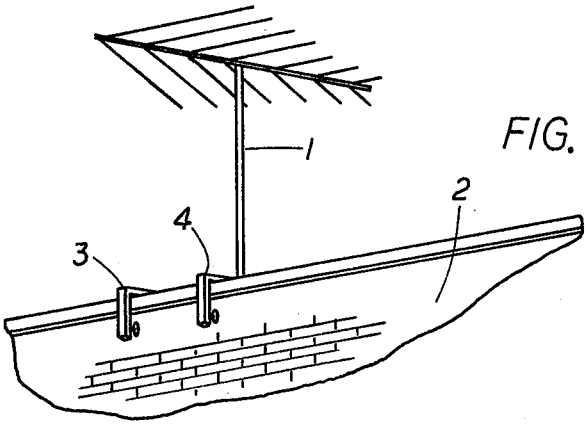
FIG. 1 is a view of part of an embodiment of the TV antenna support of the invention as mounted on a parapet.
Figure 2:
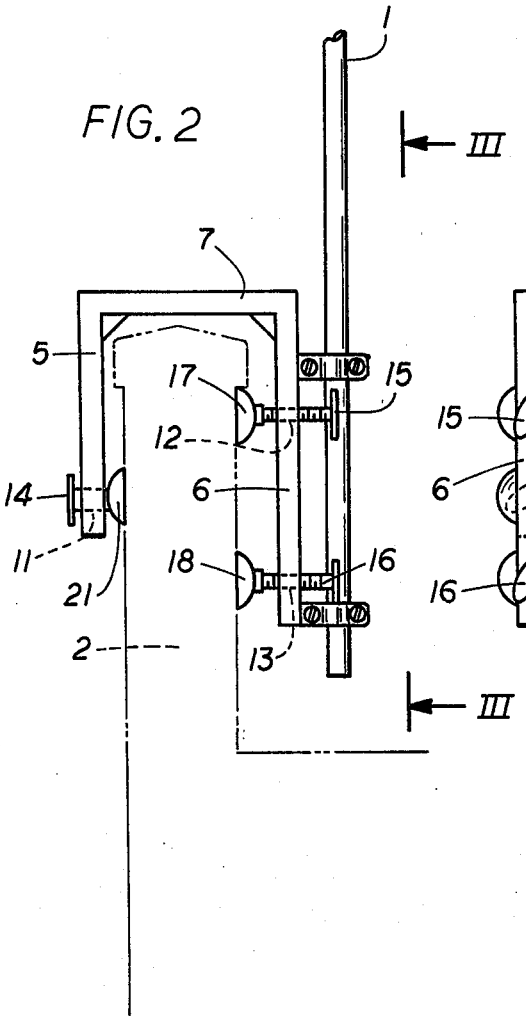
FIG. 2 is a side view of the embodiment of FIG. 1.

The antenna support of the invention comprises a pair of substantially U-shaped members 3 and 4 affixed to each other in spaced substantially parallel inverted position, as shown in FIGS. 1 and 2. Each of the members 3 and 4 has a pair of spaced substantially parallel arms joined by a head substantially perpendicular to the arms. Thus, as shown in FIG. 2, the member 4 has a pair of spaced substantially parallel arms 5 and 6 joined by a head 7 substantially perpendicular to said arms.

Figure 3:
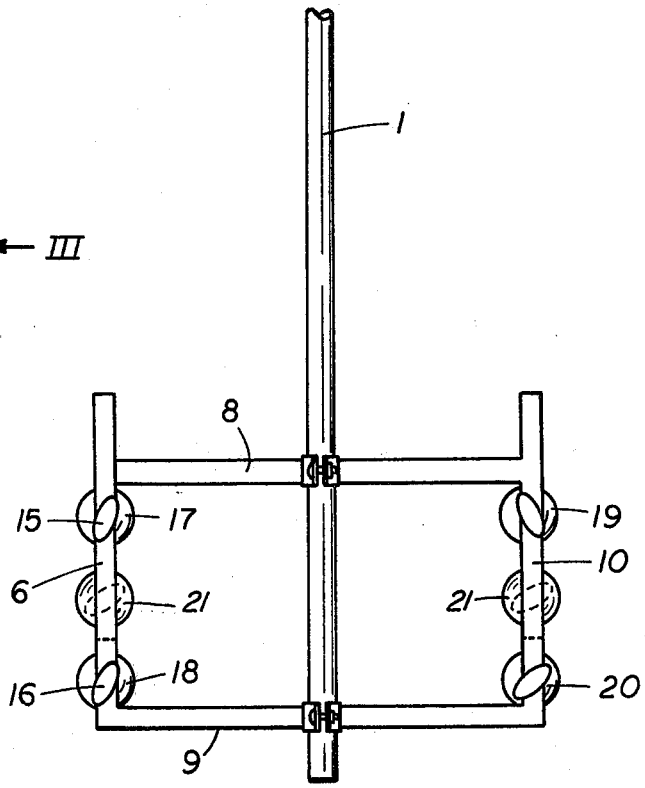
FIG. 3 is a view, taken along the lines III—III, of FIG. 2.

The U-shaped members 3 and 4 are part of a unitary structure having a pair of spaced substantially parallel crossmembers 8 and 9 affixing the U-shaped members to each other. Thus, as shown in FIG. 3, the arms 6 and 10 of the U-shaped members 4 and 3 are affixed to each other by the cross-members 8 and 9, which are substantially perpendicular to the arms and heads of the U-shaped members and lie in a plane perpendicular to the planes of the U-shaped members.

The unitary structure linking the members 8 and 9 functions as an antenna affixing device for supporting the TV antenna 1 in substantially upright position.

Fastening devices on the members 3 and 4 function to affix said members in inverse position on the parapet 2. The fastening device comprises a plurality of spaced internally threaded bores 11, 12, 13, and so on, through corresponding arms of the corresponding members 3 and 4, and wing bolts 14, 15, 16, and so on, threadedly coupled in the bores and abutting both sides of the parapet 2.

Cup-like abutting components 17, 18, 19, 20, 21, and so on, are preferably supported on the wing bolts 15, 16, and so on, at the free ends thereof for providing a larger area of abutment with the parapet.

While the invention has been described by means of a specific example and in a specific embodiment, I do not wish to be limited thereto, for obvious modifications will occur to those skilled in the art without departing from the spirit and scope of the invention.

I claim:

1. A TV antenna support for mounting a TV antenna on a parapet, said antenna support comprising a pair of substantially U-shaped members, each of the members having a pair of spaced substantially parallel arms joined by a head substantially perpendicular to the arms;

a pair of spaced substantially parallel cross-members connected to one arm of each of said pair of parallel arms and affixing the U-shaped members to each other in spaced substantially parallel inverted position, the cross-members being substantially perpendicular to the arms and heads of the U-shaped members and lying in a plane perpendicular to the planes of the U-shaped members;

antenna affixing means affixed to the cross-members for supporting a TV antenna in substantially upright position; and fastening means on the arms of said members for affixing the members in inverse position on a parapet, said fastening means comprising a plurality of spaced internally threaded bores and wing bolts threadedly coupled in the bores and abutting both sides of the parapet via cup-like abutting components supported on said wing bolts.

* * * * *